US008764322B2

(12) United States Patent
Kano et al.

(10) Patent No.: US 8,764,322 B2
(45) Date of Patent: Jul. 1, 2014

(54) RECORDING DEVICE ADVANCING TICKET ADDITIONAL DISTANCE SO THAT IT CAN BE SEEN

(75) Inventors: Tomohisa Kano, Suwa (JP); Atsushi Sakai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 664 days.

(21) Appl. No.: 12/643,826

(22) Filed: Dec. 21, 2009

(65) Prior Publication Data

US 2010/0166483 A1 Jul. 1, 2010

(30) Foreign Application Priority Data

Dec. 25, 2008 (JP) ..... 2008-329153

(51) Int. Cl.

| | |
|---|---|
| ***B41J 29/38*** | (2006.01) |
| ***B41J 11/70*** | (2006.01) |
| ***B41J 11/42*** | (2006.01) |
| ***B41J 11/66*** | (2006.01) |

(52) U.S. Cl.

CPC *B41J 29/38* (2013.01); *B41J 11/42* (2013.01); *B41J 11/666* (2013.01); *B41J 11/663* (2013.01); *B41J 11/70* (2013.01)

USPC ..... 400/76; 400/611; 400/621

(58) Field of Classification Search

USPC ..... 400/76, 621, 578, 582, 586, 611; 347/104, 218

See application file for complete search history.

(56) References Cited

U.S. PATENT DOCUMENTS

| | | | | |
|---|---|---|---|---|
| 5,531,530 | A | 7/1996 | Kuramoto et al. | |
| 6,624,903 | B1 * | 9/2003 | Miquel et al. | 358/1.12 |
| 6,676,314 | B2 * | 1/2004 | Tanaka et al. | 400/615.2 |
| 2004/0211521 | A1 | 10/2004 | Miyasaka | |
| 2006/0210347 | A1 * | 9/2006 | Kurashina | 400/719 |
| 2007/0022892 | A1 * | 2/2007 | Currans et al. | 101/483 |

FOREIGN PATENT DOCUMENTS

| | | | |
|---|---|---|---|
| JP | 60013580 | A * | 1/1985 |
| JP | 04-041283 | A | 2/1992 |
| JP | 05-301395 | A | 11/1993 |
| JP | 05301395 | A * | 11/1993 |

(Continued)

OTHER PUBLICATIONS

Non-Final Office Action, dated Jun. 12, 2013, of related U.S. Appl. No. 13/786,283.

(Continued)

*Primary Examiner* — Daniel J Colilla

(74) *Attorney, Agent, or Firm* — Kilpatrick Townsend & Stockton LLP

(57) ABSTRACT

A recording device has a recording unit that records on a recording medium, a transportation unit that conveys and discharges from an discharge opening the recording medium recorded by the recording unit, a cutting unit that cuts the recording medium recorded by the recording unit at a predetermined position on the transportation path of the transportation unit, and a control unit that causes a ticket to be output by causing the recording unit to record on the recording medium while causing the transportation unit to convey the recording medium only a specified ticket length and causing the cutting unit to cut. When a next ticket is not output after a ticket is output, the control unit causes the output ticket to be recorded and conveyed the specified ticket length, advanced a preset additional transportation distance, and then cut by the cutting unit.

5 Claims, 6 Drawing Sheets

(56) References Cited

FOREIGN PATENT DOCUMENTS

| | | | | |
|---|---|---|---|---|
| JP | 06-015892 | A | | 1/1994 |
| JP | 06-035927 | A | | 2/1994 |
| JP | 07-172009 | A | | 7/1995 |
| JP | 07214835 | A | * | 8/1995 |
| JP | 11-020278 | A | | 1/1999 |
| JP | 11-277824 | A | | 10/1999 |
| JP | 2003063071 | A | * | 3/2003 |
| JP | 2003-146504 | A | | 5/2003 |
| JP | 2003320721 | A | * | 11/2003 |
| JP | 2004345210 | A2 | | 12/2004 |
| JP | 2008-021146 | A | | 1/2008 |

OTHER PUBLICATIONS

Final Office Action, dated Oct. 24, 2013, of related U.S. Appl. No. 13/786,283.

* cited by examiner

FIG. 4A
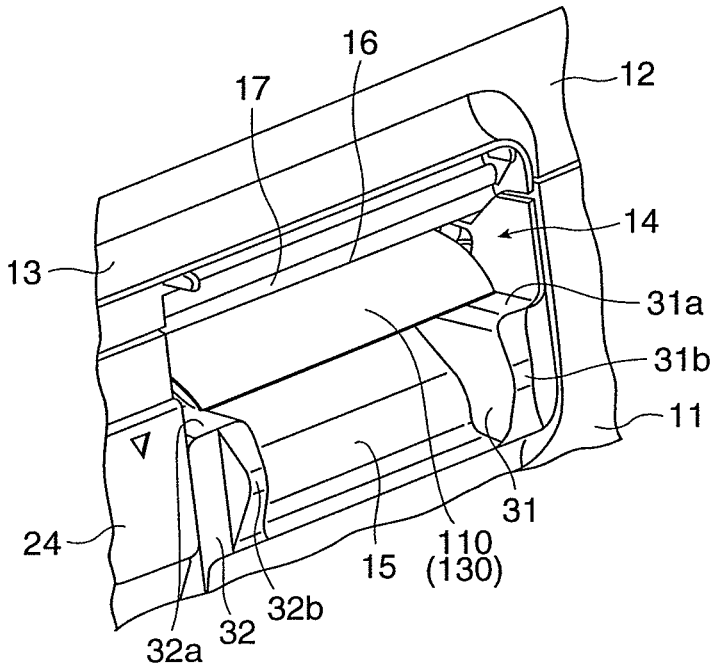
FIG. 4B
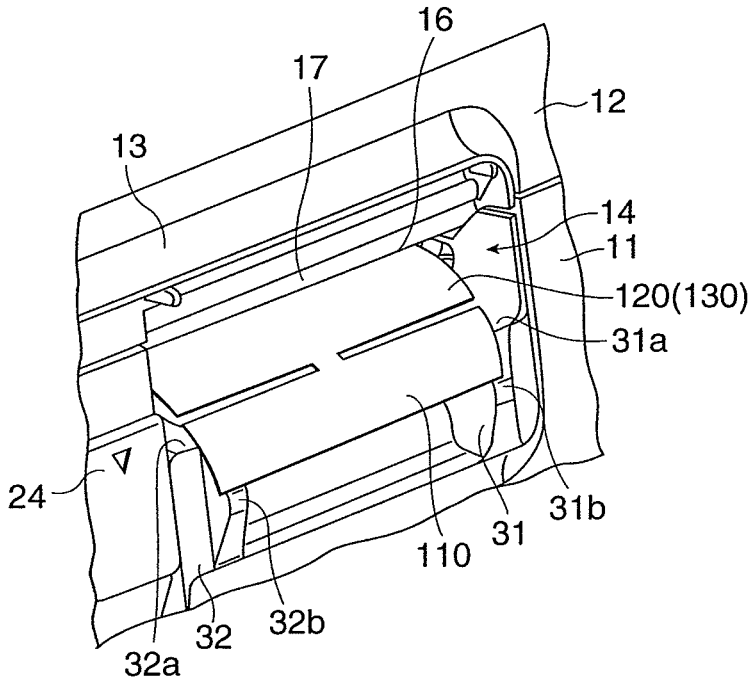
FIG. 4

FIG. 6A
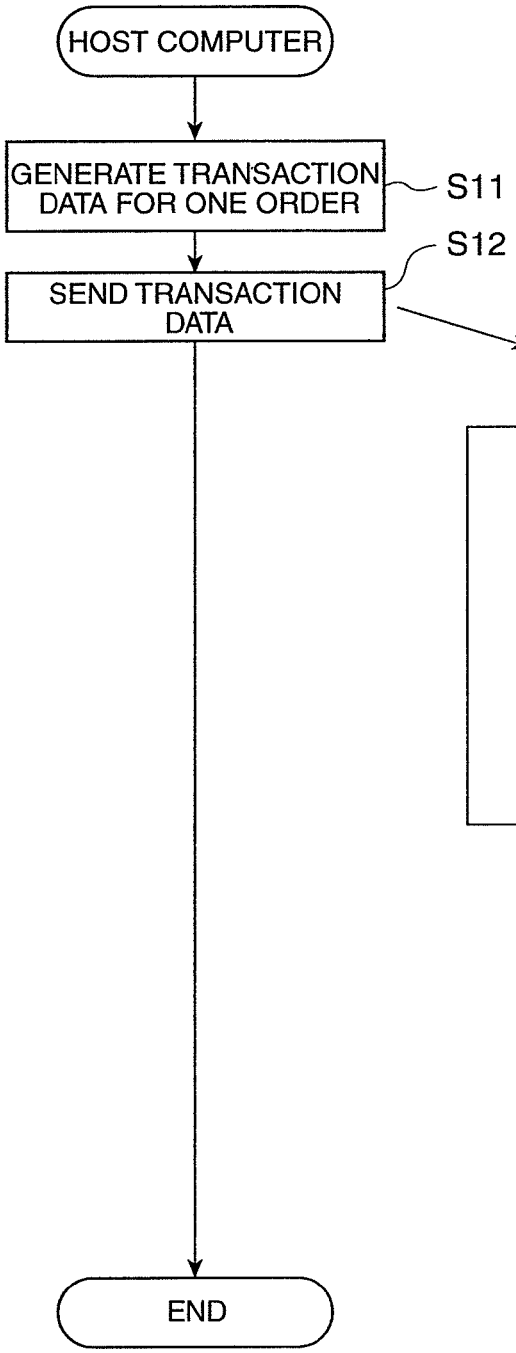
FIG. 6B
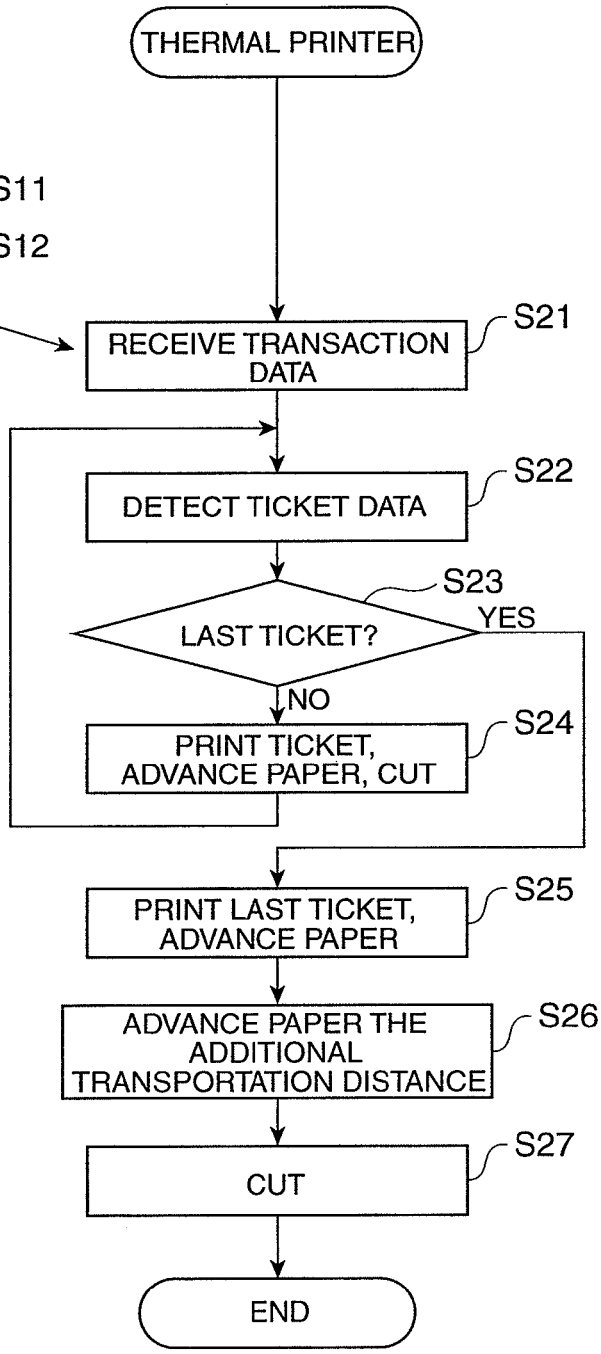
FIG. 6

RECORDING DEVICE ADVANCING TICKET ADDITIONAL DISTANCE SO THAT IT CAN BE SEEN

This application claims priority to Japanese Patent Application No. 2008-329153, filed Dec. 25, 2008 the entirety of which is incorporated by reference herein.

BACKGROUND

1. Technical Field

The present invention relates to a recording device that records on a recording medium, and to a control method for a recording device.

2. Related Art

Image recording devices that print images on a recording medium include printers that can output forms (generally referred to as "tickets" herein) that are smaller than forms of a certain fixed size. See, for example, Japanese Unexamined Patent Appl. Pub. JP-A-H06-035927. JP-A-H06-035927 teaches a kitchen printer that is used in the kitchen of a restaurant, for example, and outputs tickets for the kitchen with meal preparation instructions.

Problems can occur when such an image recording device outputs small tickets, such as it being difficult to see that a printed ticket was output from the paper exit, and the output ticket being difficult to grasp by hand.

SUMMARY

A recording device according to the present invention is configured so that the printed output can be easily seen at the time it is output and can be easily grasped even when the recording medium discharged from the image recording device is small.

A recording device according to a first aspect of the invention has a recording unit that records on a recording medium, a transportation unit that conveys and discharges from an discharge opening the recording medium recorded by the recording unit, a cutting unit that cuts the recording medium recorded by the recording unit at a predetermined position on the transportation path of the transportation unit, and a control unit that causes a ticket to be output by causing the recording unit to record on the recording medium while causing the transportation unit to convey the recording medium only a specified ticket length and causing the cutting unit to cut. When a next ticket is not output after a ticket is output, the control unit causes the output ticket to be recorded and conveyed the specified ticket length, advanced a preset additional transportation distance, and then cut by the cutting unit.

When a ticket is output and a next ticket is not output, or, more specifically, when the last ticket in a string of plural tickets is output, or when only one ticket is output, this aspect of the invention cuts only that ticket after first conveying the ticket an additional transportation distance that is added to the preset ticket length. As a result, when the image recording device stops after outputting the ticket, the ticket that was output last is longer than the other tickets by this additional transportation distance. Because this last output ticket therefore extends a greater distance from the discharge opening, the printed image is easy to see and the ticket is easy to grasp even while the last ticket is left in the discharge opening. A recording device that is easy to use even when the size of the tickets that are output by cutting the recording medium is small can therefore be easily achieved, and convenience can be improved.

Preferably, a portion of the width of the recording medium is left uncut when the cutting unit cuts across the width of the recording medium.

By leaving a portion of the width of the recording medium uncut, the tickets output from the image recording device are output while still connected at the discharge opening, will therefore not fall away from the discharge opening, and are thus prevented from becoming lost or soiled. In addition, because the ticket that is connected at the discharge opening is longer than the other tickets, the printed image is easy to see and the ticket is easy to grasp even though the ticket is left in the discharge opening.

Yet further preferably, a recessed part is formed in a side-facing surface of the case of the image recording device, and the discharge opening is formed in the back of the recessed part.

By making the ticket that is discharged last from the discharge opening longer than the specified ticket length, the ticket is easy to see and easy to grasp even in a configuration in which the discharge opening is located in the back of this recessed part. An image recording device that is easy to use even when the ticket size is small can therefore be easily achieved regardless of the location of the discharge opening, and user convenience can be improved.

Another aspect of the invention is a control method for a recording device having a recording unit that records on a recording medium, a transportation unit that conveys and discharges from an discharge opening the recording medium recorded by the recording unit, and a cutting unit that cuts the recording medium recorded by the recording unit at a predetermined position on the transportation path of the transportation unit, the control method including steps of outputting a ticket by causing the recording unit to record on the recording medium while causing the transportation unit to convey the recording medium only a specified ticket length, and then causing the cutting unit to cut, and when a next ticket is not output after a ticket is output, causing the output ticket to be recorded and conveyed the specified ticket length, advanced a preset additional transportation distance, and then cut by the cutting unit.

When a ticket is output and a next ticket is not output, or, more specifically, when the last ticket in a string of plural tickets is output, or when only one ticket is output, this aspect of the invention cuts only that ticket after first conveying the ticket an additional transportation distance that is added to the preset ticket length. As a result, when the image recording device stops after outputting the ticket, the ticket that was output last is longer than the other tickets by this additional transportation distance. Because this last output ticket therefore extends a greater distance from the discharge opening, the printed image is easy to see and the ticket is easy to grasp even while the last ticket is left in the discharge opening. A recording device that is easy to use even when the size of the tickets that are output by cutting the recording medium is small can therefore be easily achieved, and convenience can be improved.

Preferably, a portion of the width of the recording medium is left uncut when the cutting unit cuts across the width of the recording medium.

By leaving a portion of the width of the recording medium uncut, the tickets output from the image recording device are output while still connected at the discharge opening, will therefore not fall away from the discharge opening, and are thus prevented from becoming lost or soiled. In addition, because the ticket that is connected at the discharge opening is longer than the other tickets, the printed image is easy to see and the ticket is easy to grasp even though the ticket is left in the discharge opening.

Effect of the Invention

Because the last ticket output is long when the image recording device according to the invention stops, the image recording device is easy to use even when the tickets are small, and user convenience can be improved.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 is an oblique view showing the main parts near the paper exit of the printer.

FIG. 6 is a flow chart showing the operation associated with outputting a ticket.

DESCRIPTION OF EMBODIMENTS

A preferred embodiment of the present invention is described below with reference to the accompanying figures.

Figure 1:
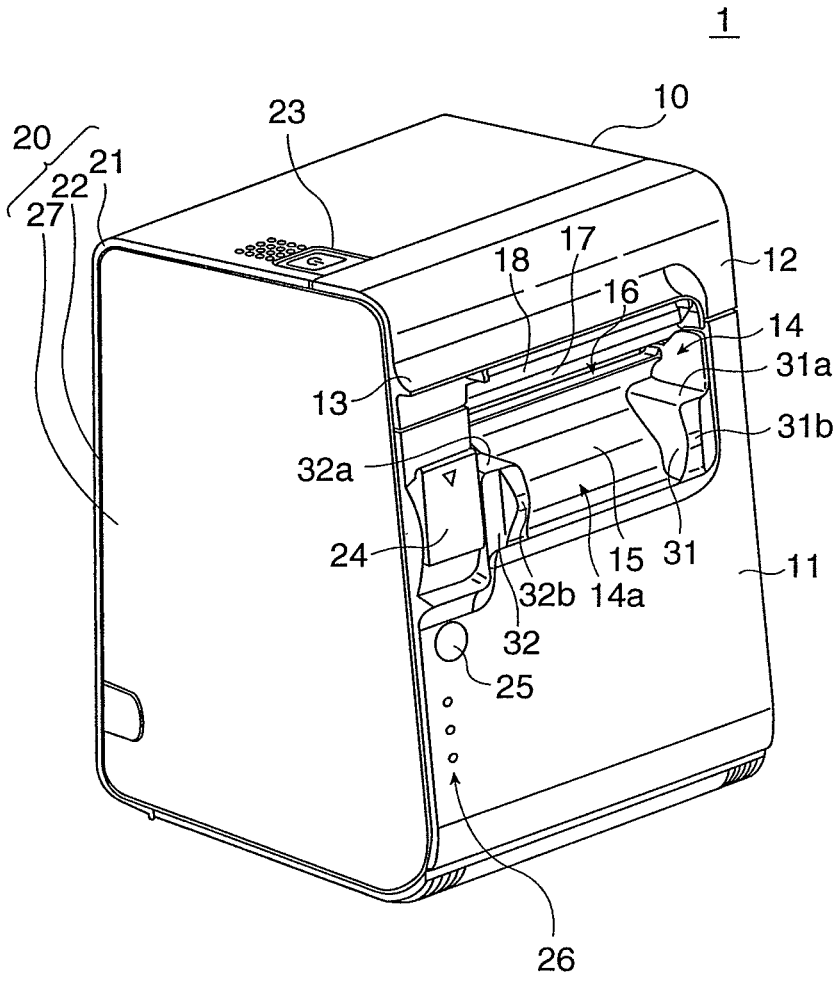
FIG. 1 is an oblique view showing a printer according to a preferred embodiment of the invention.

FIG. 1 is an oblique view of a thermal printer 1 according to a preferred embodiment of the invention.

The thermal printer 1 (referred to as simply "printer 1" below) described as an example of an image recording device is a printer that uses roll paper (not shown in the figure) made by winding thermal paper into a roll as the recording medium, and records (prints) images, including text, on the roll paper by means of a thermal head 46 (see FIG. 2) having a heating element. The printer 1 according to this embodiment of the invention is used, for example, in the kitchen of a restaurant, and outputs tickets according to food and drink orders so that the kitchen staff knows the content of the orders to be prepared.

The case 10 of the printer 1 includes a front panel 11 and top cover 12 that render the front of the printer 1 combined with a box-like case cover 20.

The case cover 20 includes a top panel 21 that renders the portion from the top to the top back part of the case 10, a back panel member 22 that renders the back and bottom of the case 10, and a pair of left and right side panels 27 that render the sides of the case 10. The side panels 27 include a side panel 27 on the side of the case 10 not seen in FIG. 1. The front panel 11, top cover 12, top panel member 21, back panel member 22, and power switch 23 are all molded plastic parts.

A paper exit 16 through which the roll paper on which images are printed by the printer 1 is discharged is formed in the front of the printer 1. The top cover 12 is disposed above the paper exit 16, and the front panel 11 is disposed below the paper exit 16.

The front panel 11 is disposed so that it can open and close to the front of the printer 1, and a release lever 24 is disposed at the side of the front panel 11. When the release lever 24 is operated, the front panel 11 opens to the front, exposing the roll paper compartment (not shown in the figure) in which the roll paper is stored inside the printer 1. The user (operator) of the printer 1 can therefore load the roll paper into the case 10 by operating the release lever 24 and opening the front panel 11.

A display unit 26 and a paper feed button 25 are disposed in the bottom part of the front panel 11. The display unit 26 includes a group of LEDs that light steady or blink according to the operating status (to indicate the on/off status of the power, printer errors, or the remaining paper level, for example) of the printer 1. The paper feed button 25 enables the user to manually advance the roll paper.

The top panel member 21 meets the top cover 12 at the top of the printer 1. The top of the case 10 is sloped relative to the installation surface on which the printer 1 is placed so that the side at the front of the printer 1 is higher than the side at the back of the printer 1. The top panel member 21 and the back panel member 22 are flat surfaces that are substantially perpendicular to the installation surface.

A push-button power switch 23 for turning the printer 1 power on and off is disposed to the top of the case 10.

The top cover 12 straddles the top part of the front of the printer 1 and the front part of the top of the printer 1.

A paper discharge unit 14 (recessed part) is rendered in the front of the printer 1, and the paper exit 16 is an opening in the inside back of the paper discharge unit 14. The roll paper on which an image is printed is discharged substantially horizontally from the paper exit 16 at a position recessed from the front of the printer 1. The paper discharge unit 14 is a recessed part with two opposing inclined surfaces, that is, a top slope 18 that extends downward from the top cover 12 to the top of the paper exit 16, and a bottom slope 15 that extends upward from the front panel 11 to the bottom of the paper exit 16, and renders a paper holding space 14*a* in front of the paper exit 16.

The printed roll paper is discharged from the paper exit 16, and as image printing and discharging the paper continue, the discharged leading end of the roll paper hangs down from the open part of the paper discharge unit 14. To make gripping the roll paper discharged from the paper exit 16 easy, a left support pedestal 31 and a right support pedestal 32 are disposed at the left and right ends of the paper discharge unit 14.

The left support pedestal 31 and right support pedestal 32 have a horizontal top surface 31*a* and 32*a*, respectively, disposed slightly below the paper exit 16. When the roll paper discharged from the paper exit 16 hangs down, or curls down due to the curl of the paper roll stored inside the case 10, or the roll paper is cut to leave an uncut center tab and curls at the corners of the support pedestals 31 and 32, the distal end of the roll paper contacts the top surfaces 31*a* and 32*a*. Because a space is created below the roll paper between the left support pedestal 31 and the right support pedestal 32 when this happens, the user can insert a finger to this space and thereby easily grip and remove the roll paper.

A front protrusion 31*b* and 32*b* is also formed at the front of the left support pedestal 31 and right support pedestal 32, respectively. The bottom ends of the left support pedestal 31 and right support pedestal 32 are substantially flush with the front of the case 10, and the front protrusions 31*b* and 32*b* protrude forward from the front of the case 10. When the roll paper is discharged from the paper exit 16 and hangs down from the outside of the paper discharge unit 14, the distal end of the roll paper is supported hanging freely from the front protrusions 31*b* and 32*b*. When the distal end of the roll paper is resting on these front protrusions 31*b* and 32*b*, the roll paper is supported hanging forward from the front of the printer 1 between the left support pedestal 31 and the right support pedestal 32.

Figure 2:
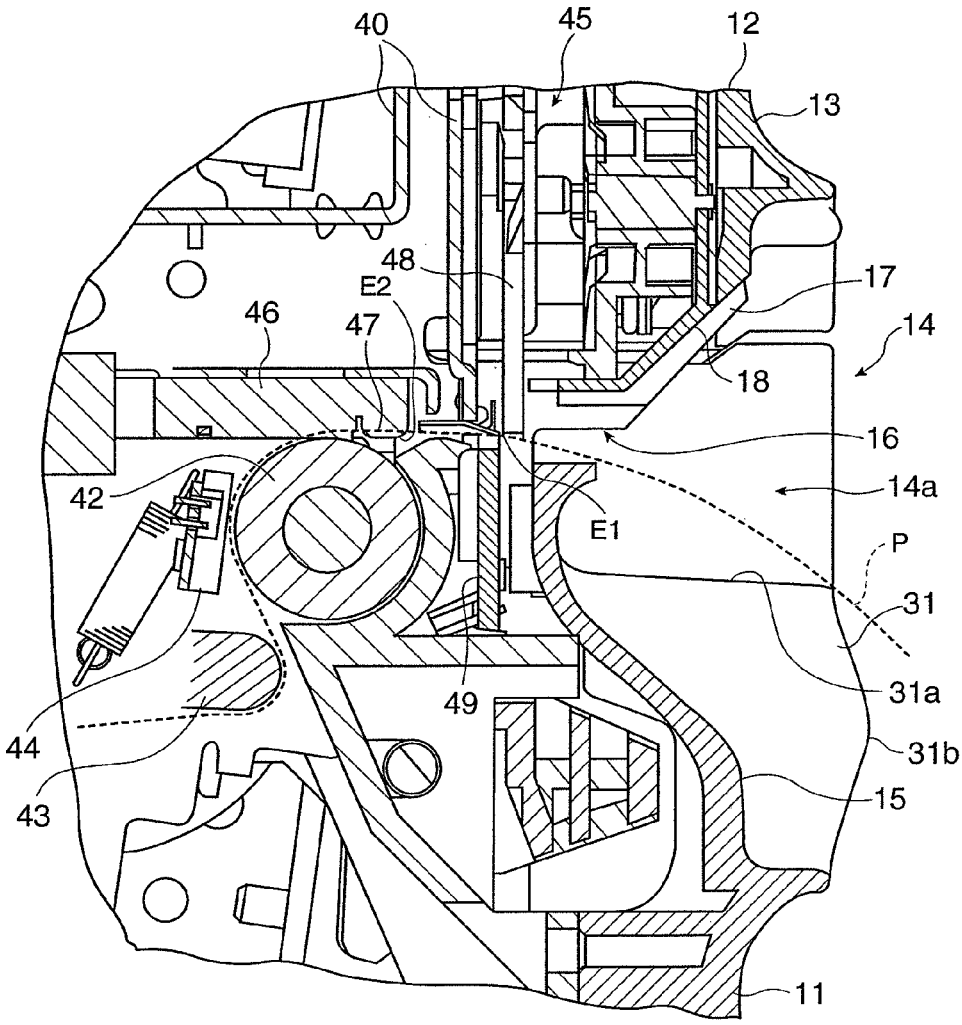
FIG. 2 is a section view showing the main parts near the paper exit of the printer.

FIG. 2 is a side section view showing the main parts near the paper exit 16 of the printer 1. The transportation path of the roll paper used as the recording medium is denoted by the imaginary line P in FIG. 2.

As shown in FIG. 1 and FIG. 2, an overhang 13 is formed projecting forward at the bottom of the top cover 12, and the top slope 18 is formed leading to the inside of the printer 1 from the bottom of the overhang 13. The bottom slope 15 is formed leading to the inside from the top of the front panel 11, and the paper exit 16 from which the roll paper is discharged is open between the back end of the bottom slope 15 and the back end of the top slope 18. While the top slope 18 is a substantially flat surface, the bottom slope 15 is a curved surface.

As shown in FIG. 2, a cutter mechanism 45 is disposed inside from the paper exit 16.

The cutter mechanism 45 has a movable knife 48 disposed above and a fixed knife 49 disposed below the transportation path P, and cuts the roll paper disposed between the movable knife 48 and fixed knife 49 when the cutter drive motor 52 (FIG. 5) and drive mechanism (not shown in the figure) cause the movable knife 48 to move vertically. The parts rendering the cutter mechanism 45, including the cutter drive motor 52, the drive mechanism (not shown in the figure), the movable knife 48 and the fixed knife 49, are disposed to a frame 40 located inside the case cover 20.

A roll paper compartment (not shown in the figure) for holding the roll paper is formed in an area in the bottom right of FIG. 2. The distal end of the roll paper held in the roll paper compartment is pulled off and up from the paper roll, and is guided by a paper guide 43 and wound around the platen roller 42. The platen roller 42 is a cylindrical platen that is driven rotationally by the transportation motor 51 (FIG. 5) to pull and convey the roll paper around the platen roller 42.

A paper detection sensor 44 that detects whether or not paper is present is disposed to touch or approach the platen roller 42 from the top side of the roll paper. The paper detection sensor 44 is a sensor for detecting if the roll paper is between it and the platen roller 42, and may be, for example, a reflection type photosensor.

The thermal head 46 is disposed opposite the platen roller 42 downstream from the paper detection sensor 44. The thermal head 46 has a heating unit 47 composed of heating elements arrayed in a line, and the heating unit 47 is pressed by the urging force of a spring (not shown in the figure) against the roll paper wound around the platen roller 42.

The printer 1 prints images, including text, on the roll paper by controlling the heat output of the heating elements in the heating unit 47 to change the color of only specific parts of the roll paper while rotating the platen roller 42 and advancing the roll paper. The roll paper on which the print image is printed is conveyed through the transportation path P over the fixed knife 49 of the cutter mechanism 45, and is cut by the cutter mechanism 45 and discharged from the paper exit 16.

A light guide 17 is affixed to the top slope 18 of the paper discharge unit 14. The light guide 17 is a transparent or semi-transparent plate made of a light-transmitting material such as glass, acrylic, or other plastic, is disposed along the top slope 18, and is fastened to the top slope 18 by adhesive, for example. The light guide 17 is a member for brightly illuminating the paper exit 16 by guiding light incident thereto from the front end and emitting the light at the paper exit 16.

Figure 3:
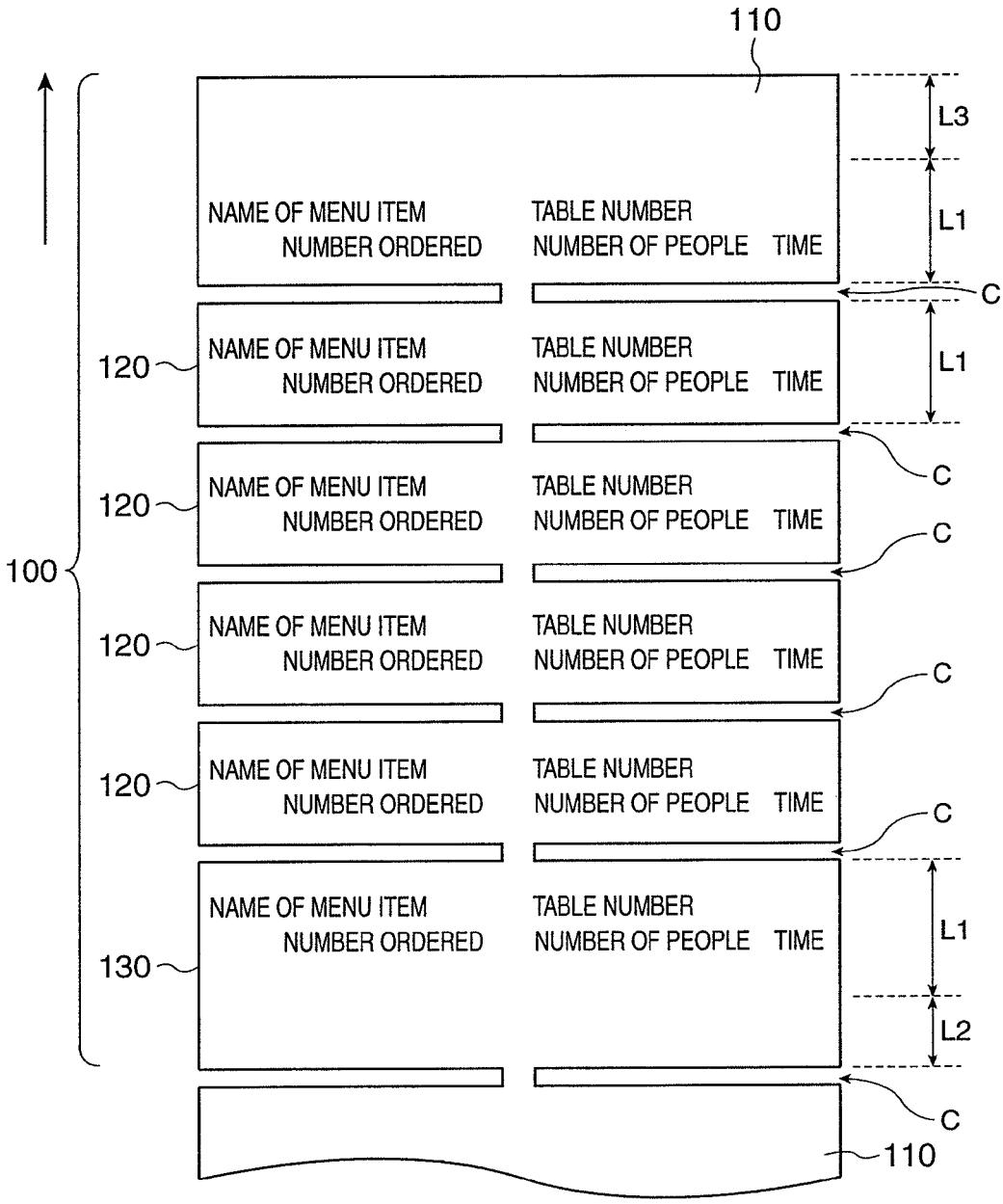
FIG. 3 is a plan view showing an example of a ticket discharged from the printer.

FIG. 3 shows an example of the roll paper output from the printer 1.

As described above, the printer 1 according to this embodiment of the invention is used for outputting order tickets (forms) in the kitchen of a restaurant, for example, and FIG. 3 is a plan view showing the output tickets. The arrow pointing to the top of FIG. 3 denotes the direction in which the tickets 110 to 130 are output.

The string of tickets 100 (referred to as a "ticket string" 100 below) shown in FIG. 3 has one or a plurality of consecutive tickets 110, 120, 130 output together in a continuous stream, and each of the individual tickets 110, 120, 130 includes the name and quantity of the ordered dishes (products), the table number of the customer that placed the order, the number of people, and the time the order was placed. A cut C is also formed by the cutter mechanism 45 between each of the tickets 110 to 130. The cuts C sever the roll paper from the outside edges to the inside of the roll paper and leave an uncut center tab between consecutive tickets. Because an uncut portion is left at each cut C, the tickets 110 to 130 remain connected to the paper exit 16, are prevented from falling one by one from the paper exit 16, and are thus prevented from becoming lost or soiled. Note that the ticket string 100 is shown following from ticket 110 in FIG. 3, and when the ticket string 100 is output from the paper exit 16 the last ticket 130 in the ticket string 100 remains connected to the leading end of the roll paper inside the case 10. When the next ticket string 100 is output, this leading end of the roll paper becomes the ticket 110 at the leading end of the next ticket string 100.

The printer 1 is connected to a host computer 5 described below. When a command to print a batch of order content input by a handheld terminal 3 (FIG. 5) is input from the host computer, the printer 1 prints and outputs a ticket string 100 as instructed.

Note that a batch of order content as used herein refers to one order received from the customers at one table, and when five different dishes are ordered at one time, for example, a ticket string 100 including a total of six tickets 110 to 130 is printed and output. Because the number of items in one order is not limited, and only one item may be ordered, the ticket string 100 may contain only one ticket. Furthermore, because the printer 1 stops after printing and outputting the ticket string 100, the user can simply take part or all of the ticket string 100 discharged from the paper discharge unit 14 of the stopped printer 1 and tear the desired portion off at the uncut portion of the cut C.

The tickets 110, 120 and tickets 130 shown in FIG. 3 are of different lengths with the ticket 110 at the leading end of the ticket string 100 and the ticket 130 at the trailing end of the ticket string 100 longer than the other tickets 120.

The basic length L1 (specified ticket length) of the tickets 110 to 130 is preset in the printer 1, and when the tickets 110 to 130 are output the printer 1 cuts the roll paper by means of the cutter mechanism 45 every time this length L1 is printed. Length L1 is 20 mm, for example, in this embodiment of the invention.

When ticket 110 and tickets 120 of the tickets included in the ticket string 100 are output, the printer 1 advances the roll paper by means of the platen roller 42 while printing the image of one ticket by means of the thermal head 46 (FIG. 2) to print the image in the range of length L1. The printer 1 then advances the roll paper while printing the images on the next tickets 120 and ticket 130, and when the paper is conveyed to where the trailing end of the ticket 110 or ticket 120 on which an image was printed reaches the position E1 shown in FIG. 2, the printer 1 drives the cutter mechanism 45 to make a cut C. A cut C is made in the roll paper every length L1 by repeating this operation.

When the last ticket 130 of the ticket string 100 is output, the printer 1 prints an image in the range of length L1 by printing an image while advancing the roll paper in the same way as with ticket 110 and tickets 120. When printing the last ticket 130, however, the printer 1 advances the roll paper by means of the platen roller 42 until the trailing end of length L1 reaches position E1 in FIG. 2, and then advances the roll paper an additional length L2 (an additional transportation distance) by means of the platen roller 42. As a result, ticket 130 is a ticket with a margin of length L3 added to the length of tickets 120.

Because this ticket 130 is at the end of the ticket string 100, it remains connected to the roll paper at the paper exit 16 when the printer 1 stops after outputting the ticket string 100 ends. Because the paper exit 16 is located inside the paper discharge unit 14 as described above, the ticket 130 that is closest to the paper exit 16 is relatively hard to see, and a ticket 130 that is small in size such as shown in FIG. 3 may be particularly difficult to see from outside the paper discharge unit 14 and difficult to grasp. However, because a margin of length L3 is added to length L1 on the last ticket 130, and the image on the ticket 130 is moved length L3 forward, the image on the ticket 130 is easy to see from the outside of the paper discharge unit 14 even while the ticket 130 remains connected in the paper exit 16. Furthermore, because this ticket 130 is longer by length L3, gripping the ticket 130 from outside the paper discharge unit 14 is also simple.

Immediately after the ticket 130 is output, the ticket 130 remains attached to the leading end of the roll paper inside the case 10. This leading end part of the roll paper produces a margin of length L3 on the ticket 110 output at the beginning of the next ticket string 100. As shown in FIG. 2, the cutting position E1 where the roll paper is cut by the cutter mechanism 45 is separated a specific distance from the position E2 where an image is printed by the heating unit 47 of the thermal head 46 as shown in FIG. 2, and immediately after the ticket 130 is output there is a length of blank roll paper between position E1 and position E2 downstream from the heating unit 47. Because the heating unit 47 cannot print to this part of the paper, a margin of length L3 equal to the distance between positions E1 and E2 is formed at the leading end of the ticket 110.

FIG. 4 is an oblique view showing the main parts near the paper discharge unit 14 of the printer 1. FIG. 4A shows when only ticket 110 is output, and FIG. 4B shows when a ticket 120 is output following ticket 110.

As shown in FIG. 4A when a single ticket 110 or ticket 130 is output from the paper exit 16, the ticket will be substantially inside the paper discharge unit 14 if the ticket is small. In addition, when a ticket 110 and a ticket 120 or ticket 130 following a ticket 110 are output from the paper exit 16 as shown in FIG. 4B, the ticket 120 or ticket 130 that is closest to the paper exit 16 is inside the paper discharge unit 14.

Therefore, when the size of the ticket 110, 120, 130 discharged from the paper exit 16 is small, the ticket may stop inside the paper holding space 14*a* and may be difficult to see from outside the printer 1 and difficult to grasp. However, because the printer 1 according to this embodiment of the invention adds a margin of length L2 to the last ticket 130 in the ticket string 100 as described above, the image on the ticket 130 is conveyed to the front of the paper holding space 14*a*. As a result, even small tickets are easy to see and easy to grip, and the user convenience of the printer 1 is improved.

Figure 5:
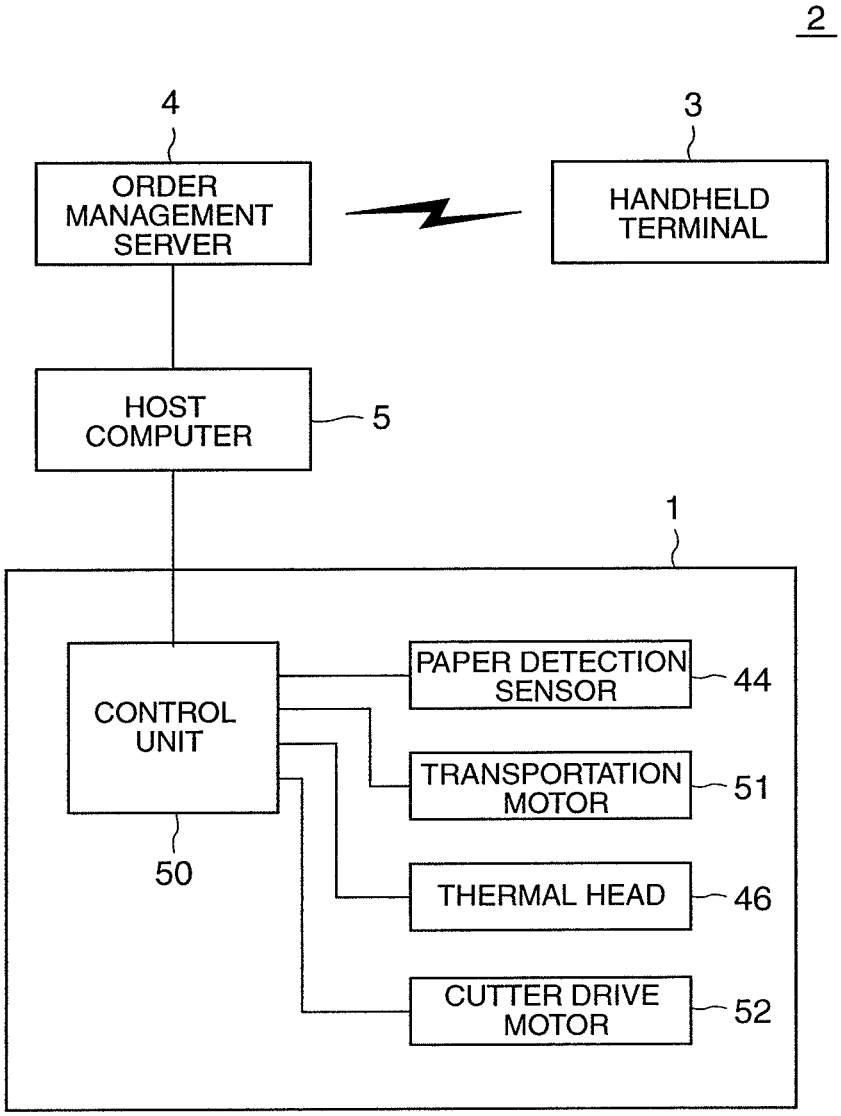
FIG. 5 is a function block diagram showing the configuration of an order management system.

FIG. 5 is a function block diagram showing the configuration of an order management system 2 in which this printer 1 is used.

The order management system 2 shown in FIG. 5 includes a printer 1, a handheld terminal 3 whereby customer servers input orders received from the customers in the restaurant in which the printer 1 is used, an order management server 4 that stores and processes data related to the orders entered from the handheld terminal 3, and a host computer 5 that sends transaction data to the printer 1 for printing based on the data stored in the order management server 4. The handheld terminal 3 and order management server 4 are wirelessly connected. The order management server 4 and host computer 5, and the host computer 5 and printer 1, are connected by a wired connection.

In this order management system 2 a customer server takes orders from customers, and using the handheld terminal 3 inputs the order content, the table number of the customer placing the order, the number of customers, and other information. The input information is then sent to the order management server 4, and the order management server 4 tabulates the information for each customer. In addition, when data for a new order is sent from the handheld terminal 3, the order management server 4 sends data related to the new order content to the host computer 5 so that the new order content is printed and output by the printer 1.

Based on the new order data sent from the order management server 4, the host computer 5 generates the transaction data that is sent to the printer 1. This transaction data is data for printing a ticket string 100 as shown in FIG. 3, corresponds to the content input as a single order from the handheld terminal 3, and is data containing the name and quantity of the ordered dishes (products), the table number of the customer that placed the order, the number of people, and the time the order was placed, for example. Paper cutting commands for cutting between the content of each ticket is included in the transaction data, and data denoting the last ticket is added to the data for the last ticket in the transaction data.

The printer 1 includes a control unit 50 connected to the paper detection sensor 44, thermal head 46, transportation motor 51, and cutter drive motor 52, and outputs a ticket string 100 as a result of the control unit 50 controlling these other parts. The thermal head 46 causes the individual heating elements of the heating unit 47 (FIG. 2) to heat according to control signals input from the control unit 50.

The transportation motor 51 may be a stepping motor, turns an angle corresponding to the pulse count determined by the drive pulses input from the control unit 50, and causes the platen roller 42 (FIG. 2) to rotate. The cutter drive motor 52 operates according to drive current input from the control unit 50, and causes the movable knife 48 of the cutter mechanism 45 (FIG. 2) to descend and cut the roll paper. The paper detection sensor 44 detects the roll paper wound around the platen roller 42, and outputs a voltage corresponding to the roll paper detection state to the control unit 50.

Note that the transportation motor 51 and platen roller 42 together renders a transportation unit, the cutter mechanism 45 including the cutter drive motor 52 renders a cutting unit, and the thermal head 46 is equivalent to a recording unit.

The control unit 50 has internal memory not shown, and a control program and data for controlling the printer 1 are stored in this memory. The data stored in this memory includes, for example, the ticket length L1 and the length L2 that is added as the additional transportation distance.

The control unit 50 monitors cutting the roll paper based on the voltage input from the paper detection sensor 44. While the roll paper is not being cut, the control unit 50 outputs drive pulses causing the transportation motor 51 to turn, and outputs control signals to the thermal head 46 to print an image on the roll paper. The control unit 50 also outputs a drive pulse to the transportation motor 51 and drive current to the cutter drive motor 52 at an appropriate timing to cause the cutter mechanism 45 to cut the roll paper.

The control unit 50 executes the foregoing operation based on the transaction data input from the host computer 5 to print and output the tickets 110, 120, 130.

FIG. 6 is a flow chart showing the operation of the order management system 2 associated with outputting a ticket string 100. FIG. 6A shows the operation of the host computer 5, and FIG. 6B shows the operation of the printer 1.

When the host computer 5 receives data related to an order from the order management server 4, it generates transaction data for one order based on the received data (step S11), and sends the data to the printer 1 (step S12).

The control unit 50 receives the transaction data sent from the host computer 5 (step S21), interprets the transaction data, and detects data for printing a ticket (step S22). The control unit 50 then determines if the detected data is the data for the last ticket in the transaction data (step S23). This decision is based on whether or not data denoting the last ticket was added to the data detected in step S22.

If it is not the last ticket (step S23 returns No), the control unit 50 prints and outputs a ticket 110 corresponding to the detected data (step S24) by conveying the roll paper by means of the transportation motor 51, printing an image by means of the thermal head 46, and making a cut C by means of the cutter mechanism 45, and then returns to step S22.

Each subsequent time step S22 executes, the control unit 50 detects the data for the next ticket in the transaction data, and in step S23 determines if the detected data is the data for the last ticket.

When the ticket data detected in the transaction data is the data for the last ticket (step S23 returns Yes), the control unit 50 advances the paper by means of the transportation motor 51 and prints an image by means of the thermal head 46 to print an image in the range of length L1, and advances this range to the outside of the paper exit 16 (step S25). The control unit 50 then drives the transportation motor 51 to advance the paper an additional length L2 (step S26), then makes a cut C by means of the cutter mechanism 45 (step S27), ends this process and stops operation.

A printer 1 according to this embodiment of the invention thus has a thermal head 46 that prints images on roll paper, a platen roller 42 that advances and discharges the roll paper from the paper exit 16, a cutter mechanism 45 that cuts the roll paper at a position E1 on the transportation path P, and a control unit 50 that controls these units and outputs tickets 110 to 130. When a ticket is output and a next ticket is not output, or, more specifically, when the last ticket 130 in a ticket string 100 is output, the control unit 50 prints the ticket 130 and advances the roll paper a length L1 that is set as the ticket length, then advances the roll paper an additional preset length L2, and then cuts the paper by means of the cutter mechanism 45. As a result, when the last ticket 130 is output or only a single ticket 130 is output, that ticket 130 is longer than the other tickets 120 by length L2. Because the last output ticket 130 therefore extends a greater distance from the paper exit 16, the printed image is easy to see and the ticket is easy to grasp even while the last ticket is left in the paper exit 16. A printer 1 that is easy to use even when the size of the tickets 110 to 130 that are output by cutting roll paper is small can therefore be easily achieved, and user convenience can be improved.

More particularly, because a margin equal to length L2 is formed on the ticket 130 below the image printed by the thermal head 46, the portion where the image is printed is pushed far out from the paper exit 16. The visibility of the image on the ticket 130 can thus be improved by increasing the feed distance.

Furthermore, because the cutter mechanism 45 makes cuts C that leave a portion of the roll paper uncut across the width of the paper, the tickets 110 to 130 output from the printer 1 remain connected at the paper exit 16 so that they do not fall out and away from the paper exit 16, and are prevented from becoming lost or soiled. Furthermore, because the ticket 130 that remains connected at the paper exit 16 is longer than the other tickets 120, the image printed thereon is easy to see and the ticket is easy to grasp by hand even though the ticket 130 is left in the paper exit 16.

Yet further, while the paper exit 16 opens at a position inside the case 10 of the printer 1 into the paper discharge unit 14 formed in the front and the ticket 130 may be difficult to see when inside the paper discharge unit 14, the last ticket 130 is longer than the preset ticket length L1 and is therefore easy to see and easy to grasp even while connected at the paper exit 16. The printer 1 is thus extremely easy to use and user convenience can be improved even when the size of the ticket 130 is small regardless of the position of the paper exit 16.

It will be obvious to one with ordinary skill in the related art that the foregoing embodiment describes a preferred application of the invention, but the invention is not limited to the foregoing embodiment. For example, the foregoing embodiment describes a configuration in which the paper discharge unit 14 is rendered in the front of the case 10, but the invention is not so limited. More specifically, the paper discharge unit 14 may be rendered in any side-facing surface, including any other side, upward-facing inclined surfaces and downward-facing inclined surfaces.

The cutting operation of the cutter mechanism 45 is also not limited to cutting actions that make cuts C leaving the center part of the tickets 110 to 130 uncut, and may leave an edge part uncut. The cutter mechanism 45 may also be configured to cut the roll paper in a scissor action using two or more movable knives. A configuration that cuts roll paper by means of one movable knife and a cutting block that receives the movable knife is also conceivable.

The foregoing embodiment also describes using thermal roll paper as the recording medium, but synthetic resin or natural fiber sheets can be used instead of paper as the recording medium. A surface treatment may also be applied to such sheets. The sheets may also be cut sheets, continuous sheets, or rolled sheets, and the cut sheets may be single part sheets or multi-part forms.

The recording unit of the printer 1 is also not limited to a thermal head for printing images on thermal roll paper by means of a thermal head 46. For example, an inkjet head that prints images by discharging ink onto the recording medium, a dot impact recording head, a dye sublimation printer, and other types of recording heads can be used.

The transportation unit that conveys the recording medium is also not limited to a platen roller 42, and other transportation rollers may be used.

It will be obvious to one with ordinary skill in the related art that other aspects of the detailed configuration of the printer 1 may be changed as desired.

The invention is also not limited to printers, and can obviously also be applied to other electronic devices having a printer.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A recording device comprising:

a recording unit that records on a recording medium;

a transportation unit that conveys and discharges from a discharge opening the recording medium recorded on by the recording unit;

a cutting unit that cuts the recording medium recorded on by the recording unit at a predetermined position on a transportation path of the transportation unit; and a control unit that causes a string of two or more tickets to be output by causing the recording unit to record on the recording medium while causing the transportation unit to convey the recording medium a specified ticket length for each of the two or more tickets and causing the cutting unit to cut between the tickets of at least one adjacent pair of the two or more tickets, and when a final ticket of the two or more tickets is output, causes the final ticket to be conveyed a preset additional transportation distance, and then cut by the cutting unit, wherein a length of the final ticket is longer than the specified ticket length.

2. The recording device described in claim 1, wherein:

when the cutting unit cuts across the width of the recording medium, a portion of the width of the recording medium is left uncut.

3. The recording device described in claim 1, wherein:

a recessed part is formed in a side-facing surface of the case of the recording device, and the discharge opening is formed in the back of the recessed part.

4. A control method for a recording device having a recording unit that records on a recording medium, a transportation unit that conveys and discharges from a discharge opening the recording medium recorded by the recording unit, and a cutting unit that cuts the recording medium recorded by the recording unit at a predetermined position on the transportation path of the transportation unit, the control method comprising:

outputting a string of two or more tickets by causing the recording unit to record on the recording medium while causing the transportation unit to convey the recording medium a specified ticket length for each of the two or more tickets;

causing the cutting unit to cut between the tickets of at least one adjacent pair of the two or more tickets; and when a final ticket of the two or more tickets is output, causing the final ticket to be conveyed a preset additional transportation distance, and then cut by the cutting unit, wherein a length of the final ticket is longer than the specified ticket length.

5. The control method for a recording device described in claim 4, wherein:

when the cutting unit cuts across the width of the recording medium, a portion of the width of the recording medium is left uncut.

* * * * *